United States Patent [19]

Ney et al.

[11] Patent Number: 4,707,045

[45] Date of Patent: Nov. 17, 1987

[54] SHIELDED MICROMINIATURE MULTI-PIN CONNECTOR

[75] Inventors: Reuben E. Ney, Mount Joy; Bryon L. Walters, Camp Hill, both of Pa.

[73] Assignee: AMP Incorporated, Harrisburg, Pa.

[21] Appl. No.: 939,305

[22] Filed: Dec. 5, 1986

Related U.S. Application Data

[63] Continuation of Ser. No. 798,644, Nov. 15, 1985, abandoned.

[51] Int. Cl.[4] ..... H01R 13/52

[52] U.S. Cl. ..... 439/588; 439/252; 439/271; 439/608

[58] Field of Search ..... 339/60 R, 60 M, 64 R, 339/64 M, 94 R, 94 M, 143 R, 218 M

[56] References Cited

U.S. PATENT DOCUMENTS

| | | | |
|---|---|---|---|
| 2,379,942 | 7/1945 | Webber | 339/60 R |
| 3,181,104 | 4/1965 | Oxley | 339/64 M |
| 3,456,231 | 7/1969 | Paullus et al. | 339/60 |
| 3,564,709 | 2/1971 | Hickton | 339/218 M |
| 3,787,796 | 1/1974 | Barr | 339/94 R |
| 3,842,393 | 10/1974 | Glover et al. | 339/60 |
| 3,850,495 | 11/1974 | Glover | 339/60 M |
| 3,851,296 | 11/1974 | Muchmore et al. | 339/94 M |
| 3,888,559 | 6/1975 | Geib | 339/94 M |
| 4,090,759 | 5/1978 | Herrmann, Jr. | 339/60 M |
| 4,116,521 | 9/1978 | Hermann, Jr. | 339/60 |
| 4,189,204 | 2/1980 | Brown et al. | 339/275 |
| 4,265,503 | 5/1981 | Baur | 339/45 |
| 4,401,355 | 8/1983 | Young | 339/147 |
| 4,451,107 | 5/1984 | Dola et al. | 339/143 R |
| 4,479,689 | 10/1984 | Marmillion et al. | 339/89 |

OTHER PUBLICATIONS

"LGH High Voltage Lead Assemblies, Connectors and Receptacles", AMP Incorporated, Harrisburg, Pennsylvania 17105, May 1983.

*Primary Examiner*—John McQuade
*Attorney, Agent, or Firm*—Katherine A. Nelson

[57] ABSTRACT

A microminiature, multi-pin electrical connector for high voltage applications. The connector includes a plug portion including a resilient body member having a plurality of cavities therein, and a receptacle portion having a plurality of extended members. When the plug and receptacle portions are connected, the extended members extend into the cavities to mate terminal means within the cavities and extended portions. The receptacle portion includes means for supporting the extended members while permitting them to move independently relative to one another. Radial and axial compression seals, preferably formed integral with the resilient body member, are provided to seal between the peripheral surface of each cavity and the outer peripheral surface of each extended member, and the base surface of each cavity and the extended end surface of each extended member, respectively. The seals permit the extended members to float and automatically align themselves within their associated cavities to ensure the establishment and maintenance of an effective seal between the walls of the cavities and the extended members. The connector portions include outer metal housings, and the resilient body member includes an integral annular flange for sealing between the housings when the connector portions are connected to provide a substantially fully shielded connector capable of carrying 6 KVDC within a temperature range of about −55° C. to about +125° C. and over a broad range of pressure.

6 Claims, 8 Drawing Figures

12
51
62
52
52a
53
54
57
63a
61
61a
59
63b
63
58
58b
58a
56

SHIELDED MICROMINIATURE MULTI-PIN CONNECTOR

This application is a continuation of application Serial No. 798,644 filed Nov. 15, 1985, now abandoned.

BACKGROUND OF THE INVENTION

The present invention relates generally to multi-pin electrical connectors and, in particular, to microminiature multi-pin connectors for use in high-voltage applications.

Multi-pin electrical connectors are often used in applications which require extreme reliability of performance under severe environmental conditions. For example, such connectors are frequently incorporated into high-voltage electronic circuits within aircraft and must operate reliably at up to 6 KVDC or more within a broad temperature and pressure range. In addition, because of space and weight limitations, the connectors must be as compact and lightweight as possible consistent with maintaining the pins electrically isolated from one another. If the pins are not separated from one another by a sufficient distance, or otherwise electrically isolated from one another, arcing and other losses can occur.

Commonly assigned U.S. Pat. No. 3,842,393, issued on Oct. 15, 1974, discloses a high-voltage microminiature multi-pin connector which can be assembled in a package of about one-half inch by one inch. the connector includes a receptacle portion and a socket plug portion adapted to be connected together to complete electrical circuits through the connector. The receptacle portion includes a relatively rigid, plastic body defining an outer shroud and a plurality of integral, inner, cylindrical members each of which contain a socket terminal. The plug portion includes a hard, plastic, outer body having a non-conductive, resilient insert bonded thereto. The insert contains a plurality of cylindrical cavities each of which contain a pin terminal.

When the plug and receptacle portions are connected, the cylindrical members extend into the cylindrical cavities causing the pin and socket terminals to mate to complete electrical connections through the connector.

In the connector disclosed in U.S. Pat. No. 3,842,393, the cavities in the resilient insert are formed with peripheral walls of undulating shape to define a plurality of integral, resilient O-rings which extend around the peripheral walls of the cavities. When the cylindrical members of the receptacle portion are extended into the cavities upon connection of the connector portions, the O-rings are caused to deform and spread out to form spaced, annular, insulating seals between the peripheral walls of the cavities and the outer peripheral surfaces of the cylindrical members to electrically isolate adjacent terminals from one another and to mechanically prevent debris from entering between the cylindrical members and the walls of their associated cavities.

Because the cylindrical members in the connector disclosed in U.S. Pat. No. 3,842,393 are rigidly connected together, the connector must be manufactured within fairly narrow tolerances. Specifically, if one or more of the cylindrical members is not accurately aligned with its associated cavity, an incomplete seal can result therebetween, preventing effective electrical isolation between adjacent terminals. Also, even slight misalignment can cause substantial rubbing between a cylindrical member and the walls of its associated cavity each time that the connector is connected or pulled apart. The resulting friction can rapidly deteriorate the resilient walls of the cavities, greatly reducing the life span of the connector.

Also, the connector of U.S. Pat. No. 3,842,393 is unshielded; and there are many applications in which a shielded connector is necessary or preferred for added strength and reliability.

SUMMARY OF THE INVENTION

In accordance with the present invention, a multi-pin electrical connector is disclosed which comprises a first connector portion or plug and a second connector portion or receptacle. Each connector portion comprises a sub-assembly including electrical terminals attached to electrical conductor means sealingly positioned within dielectric means, the subassembly being disposed in housing means.

The plug portion includes means defining a plurality of cavities in the dielectric means, each of the plurality of cavities containing an electrical terminal. The receptacle portion which is adapted to be connected to the plug portion includes a plurality of extended members positioned to extend into the plurality of cavities when the first and second connector portions are connected. Each of the plurality of extended members contain a terminal to be mated with the terminals in the cavities when the extended members extend into the cavities. The receptacle portion further includes means for supporting the plurality of extended members while permitting the extended members to move independently relative to one another, and sealing means for sealing between each extended member and its associated cavity when the extended members extend into the cavities.

With the present invention, each extended member is capable of moving independently of every other extended member in the receptacle portion. Accordingly, when the plug and receptacle portions are connected, each extended member will automatically move to properly align itself within its associated cavity to ensure that a complete and effective seal will be established between each extended member and the walls of its associated cavity. This will ensure that all adjacent terminals will be properly electrically isolated from one another and that the space between each extended member and the walls of its associated cavity will be properly mechanically sealed at all times to prevent voltage breakdown and also prevent dust or other debris from entering therebetween.

Also, because the extended members are movable within their respective cavities, friction between each extended member and the walls of its associated cavity when the connector portions are connected or pulled apart will be minimized, thus reducing wear of the resilient walls of the cavities and extending the useful life of the connector.

In addition, because the extended portions automatically align themselves within their respective cavities, the connector can be manufactured within somewhat reduced tolerance requirements, resulting in fewer rejects and lower manufacturing costs.

In accordance with a presently preferred embodiment, each extended member comprises a separate cylindrical member adapted to extend into cylindrical cavities in the plug connector portion. The receptacle portion further includes a retaining member having a plurality of slots for receiving and retaining a plurality of flexible conductor wires which extend into the receptacle portion and are electrically connected to the terminals contained in the cylindrical members. By retaining the conductor wires, the cylindrical members are prevented from moving longitudinally within the receptacle portion, but are otherwise free to move independently relative to one another to establish and maintain proper alignment within its associated cavity.

In accordance with a further aspect of the invention, the sealing means between each extended member and the walls of its associated cavity includes both a radial seal to seal between the peripheral walls of the cavities and the outer peripheral surfaces of the extended members and an axial compression seal to seal between the base surfaces of the cavities and the extended end surfaces of the extended members. The use of both radial seals and axial compression seals between each extended member and the walls of its associated cavity permits the extended members to essentially float within their respective cavities surrounded by the resilient sealing structure, resulting in a connector that is safe and reliable under even severe environmental conditions.

According to a presently preferred embodiment of the invention, the cavities are formed within a resilient dielectric body membere which is insert molded around the pin terminals. The radial seal comprises a plurality of resilient sealing portions that function as O-rings formed integral with the body member and extending around the periphery of each cavity at spaced locations thereon. The axial compression seal comprises an annular seal also formed integral with the first dielectric body member and extending from the base surface of each cavity and surrounding a portion of the pin terminal.

According to a further aspect of the invention, both the first and second housing portions of the two subassemblies include a metal housing which surrounds the dielectric body means portions and which substantially encloses the connector when the plug and receptacle portions are connected to provide shielding and increased strength to the connector. The resilient first dielectric body member includes an integral, annular, sealing flange positioned to seal between the housings of the two connector portions when they are connected together.

In general, the present invention provides a microminiature multi-pin electrical connector suitable for use in high-voltage applications of 6 KVDC or more and capable of operating reliably and safety throughout a temperature range of from −55° C. to 125° C. and over a broad range of pressure. The connector maintains effective isolation between adjacent terminals at all times, prevents voltage breakdown, and does not require the use of potting materials, as commonly required in such connectors. In addition, the connector is substantially fully shielded by an outer metal housing without any increase in the size of the connector as compared to the unshielded connector disclosed in U.S. Pat. No. 3,842,393. The connector of the present invention is also fully interchangeable with the connector in U.S. Pat. No. 3,842,393.

Further advantages and specific features of the invention will become apparent hereinafter in the following detailed description of a presently preferred embodiment taken in conjunction with the drawings.

DETAILED DESCRIPTION OF THE PREFERRED EMBODIMENT

Figure 1:
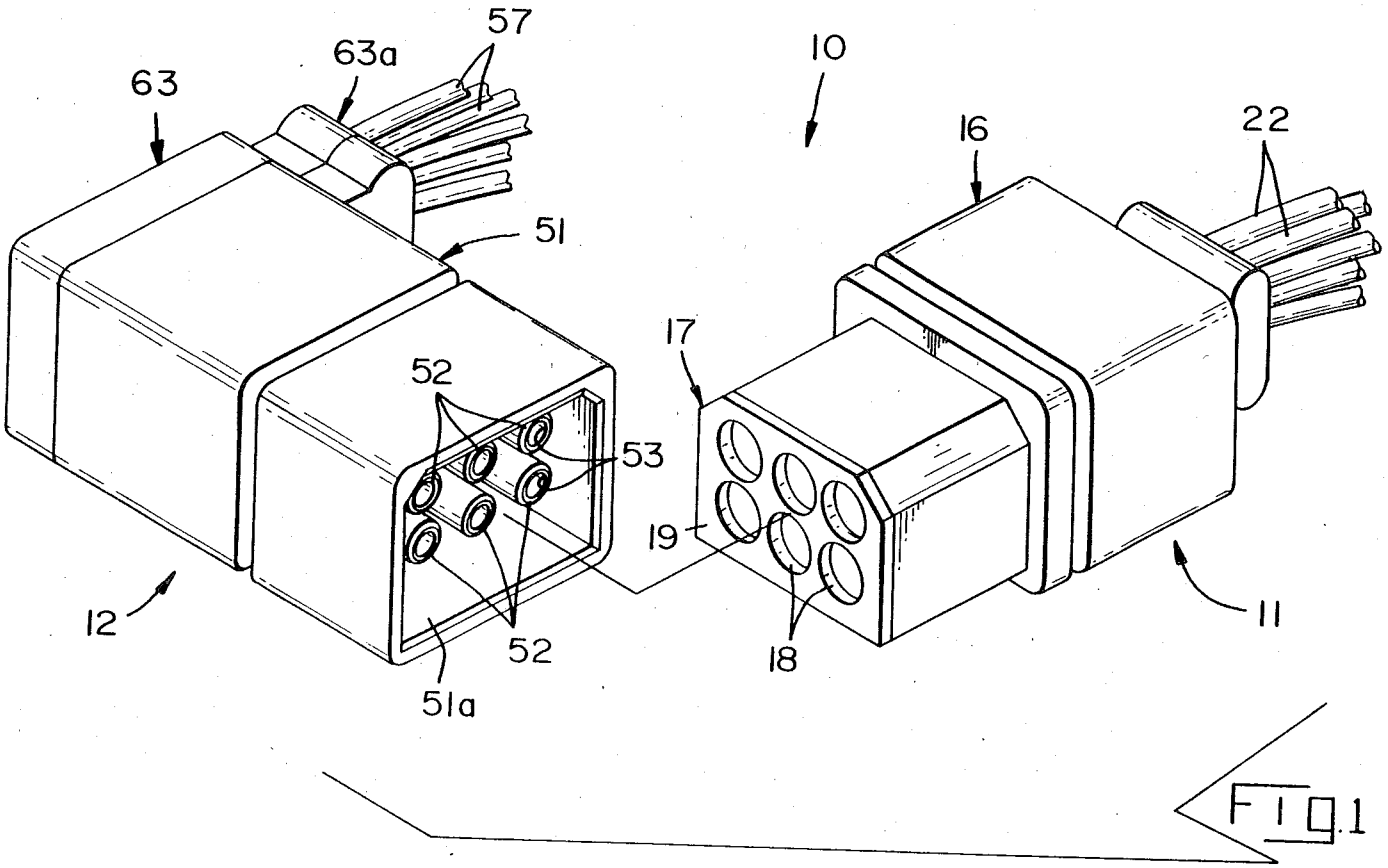
FIG. 1 is an perspective view of the plug and receptacle portions of a connector according to a presently preferred embodiment of the invention.

FIGS. 1 to 8 illustrate a high-voltage, microminiature, multi-pin, electrical connector according to a presently preferred embodiment of the invention. The connector is generally designated by reference numeral 10 and, as best shown in FIG. 1, comprises a first connector or plug portion 11 and a second connector or receptacle portion 12 adapted to be connected together to complete electrical circuits through the connector.

Figure 2:
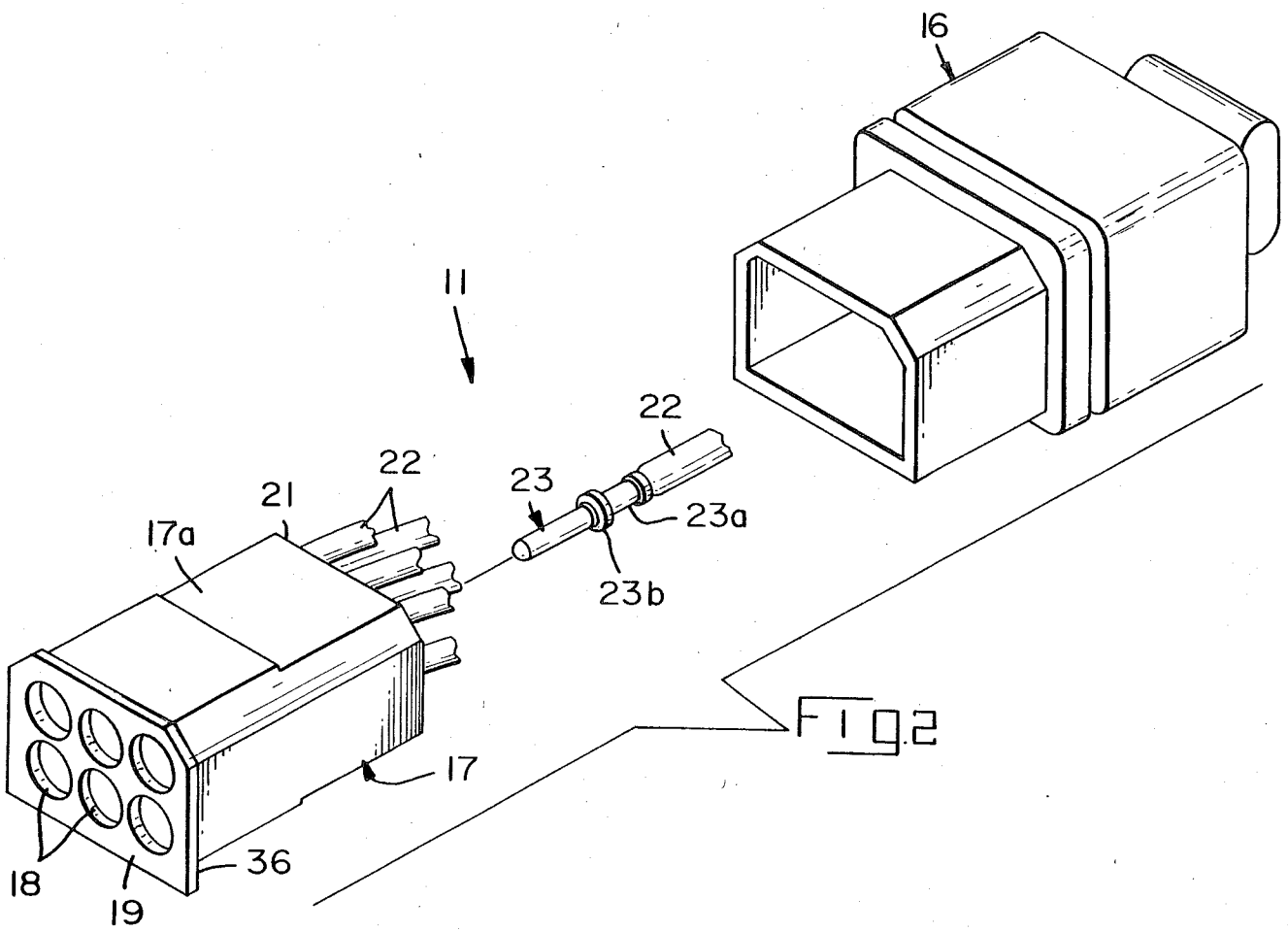
FIG. 2 is an exploded perspective view of the plug portion of the connector of FIG. 1.
Figure 4:
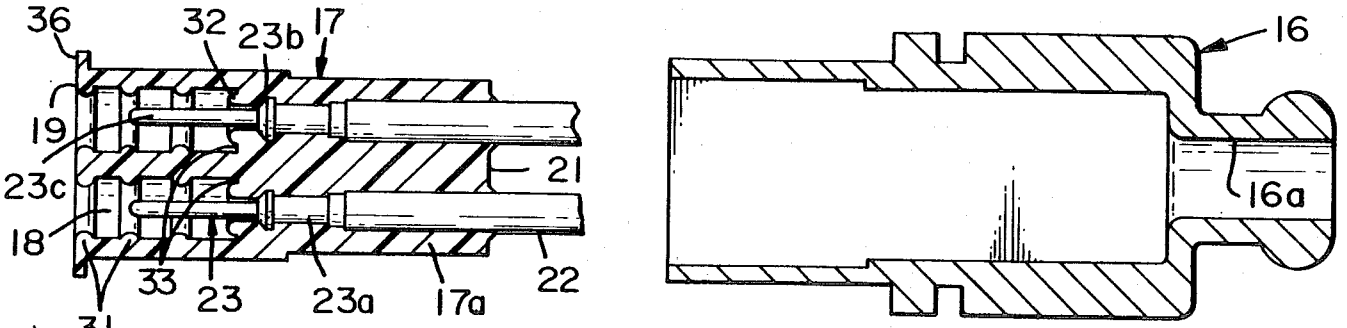
FIG. 4 is a cross-sectional view of the plug portion of the connector of FIG. 1 with the housing separated from the plug assembly.
Figure 6:
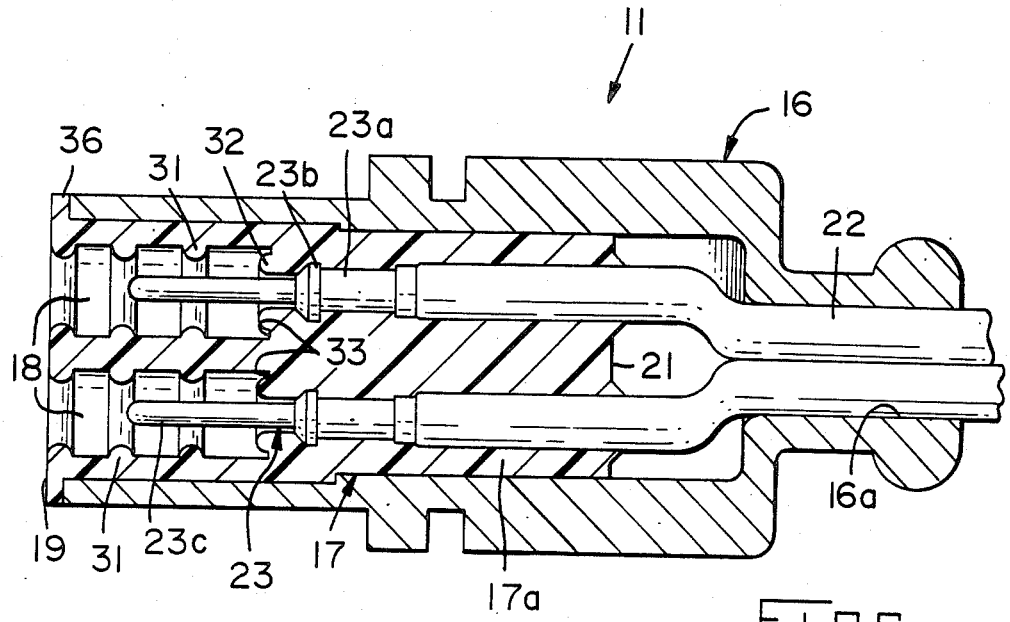
FIG. 6 is a cross-sectional view of the assembled plug portion of the connector of FIG. 1.

Plug portion 11 is illustrated in greater detail in FIGS. 2, 4 and 6, and comprises a rigid outer housing or shell 16 surrounding a relatively resilient, subassembly 17. Subassembly 17 is comprised of a dielectric body member 17*a* having a plurality of cavities 18 therein, which extend rearwardly from front face 19. Subassembly 17 further has a like plurality of electrical pin terminals 23 terminated to electrical conductor wires 22 sealingly positioned within body member 17*a* with one end 23*c* of each terminal 23 extending into an associated cavity 18 as shown in FIG. 4. Conductor wires 22 preferably comprise Teflon- or silicone-insulated wires. As will be explained more fully hereinafter, cavities 18 are substantially cylindrical in shape and are sized to receive a plurality of cylindrical members 52*a* of the receptacle portion 12 of the connector upon connection of the plug and receptacle portions.

Connector body 17*a* comprises a resilient, readily deformable body member of plastic or rubber; and a presently preferred material for connector body 17*a* comprises a silicone. Rigid housing 16 comprises a metal housing to provide shielding and strength to the connector 10. Anyone of a number of metals as known in the art may be used for the housing depending, inter alia, upon the environmental conditions to which the connector will be subjected and cost factors.

Figure 8:
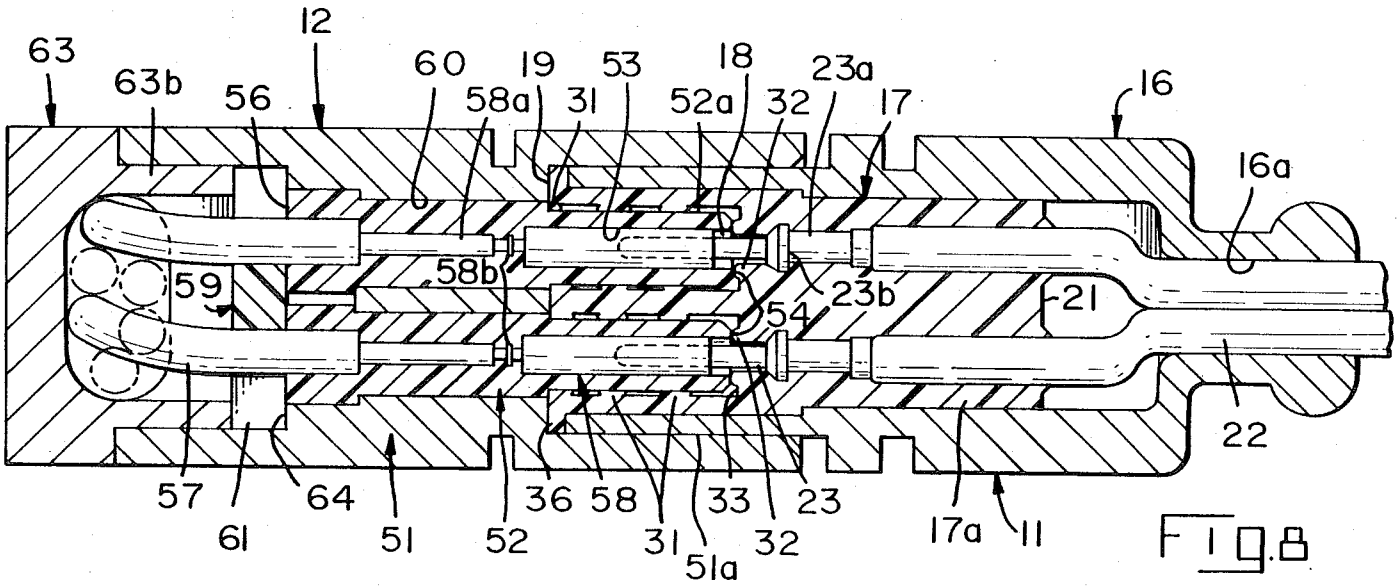
FIG. 8 is a cross-sectional view of the connector of FIG. 1 in connected condition.

Subassembly 17*a*, the terminals 23, and their associated conductors are assembled as an integral unit to form subassembly 17. A presently preferred method for manufacturing plug portion 11 comprises first crimping, soldering or otherwise attaching the terminals 23 having wire barrel portions 23*a* to the ends of the conductor wires 22 and placing the conductor wires 22 and attached pin terminals 23 into a mold. The material to form connector body 17*a* is then introduced into the mold; and connector body 17*a* is insert molded around the ends of conductor wires 22, and a portion of terminals 23, to seal and bond body member 17*a* to the wire and terminal portions contained therein. Subassembly 17 is then placed into metal housing 16 and bonded to the inside surface of the housing by a suitable bonding material that is compatable with the dielectric mold material and metal. Ferrules 23*a* preferably have an enlarged portion 23*b* which provides both retention means and strain relief means for the connector. The conductor wires 22 extend rearwardly from rear face 21 of subassembly 17 and through opening 16*a* in the end of housing 16, as shown in FIGS. 6 and 8.

Figure 3:
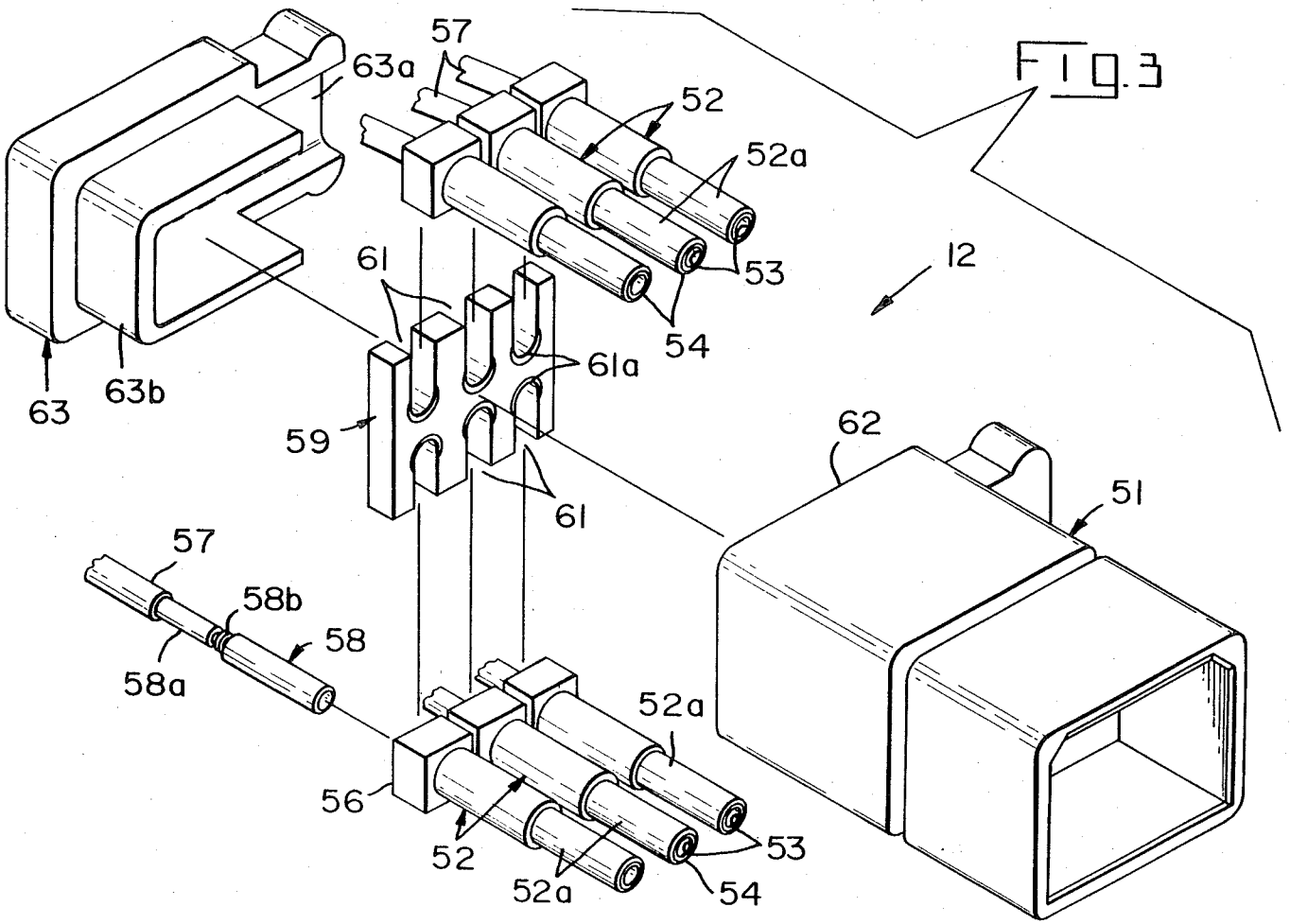
FIG. 3 is an exploded perspective view of the receptacle portion of the connector of FIG. 1.
Figure 5:
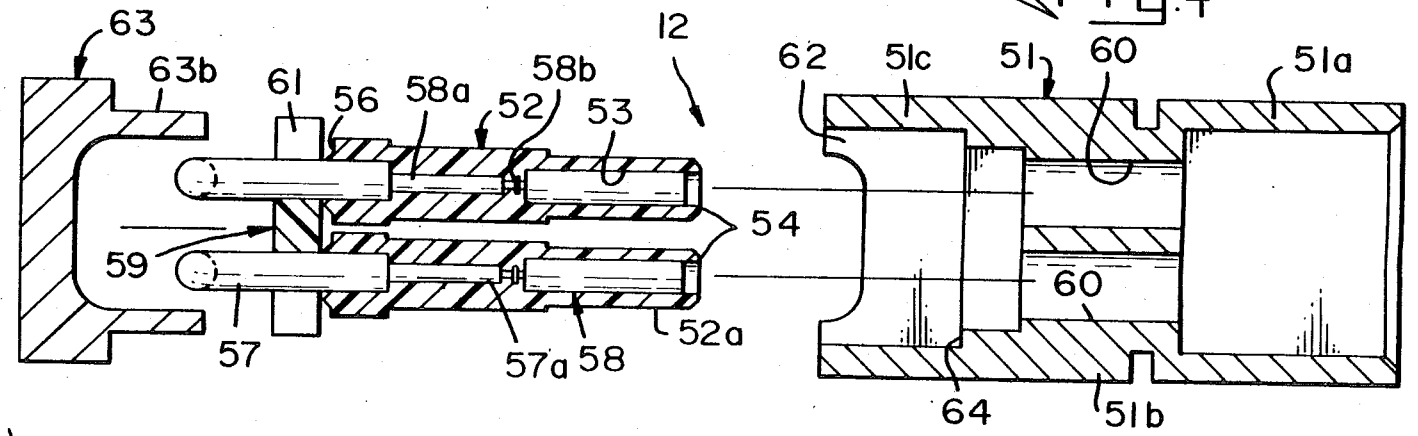
FIG. 5 is a cross-sectional view of the receptacle portion of the connector of FIG. 1 with the housing separated from the receptacle subassembly.
Figure 7:
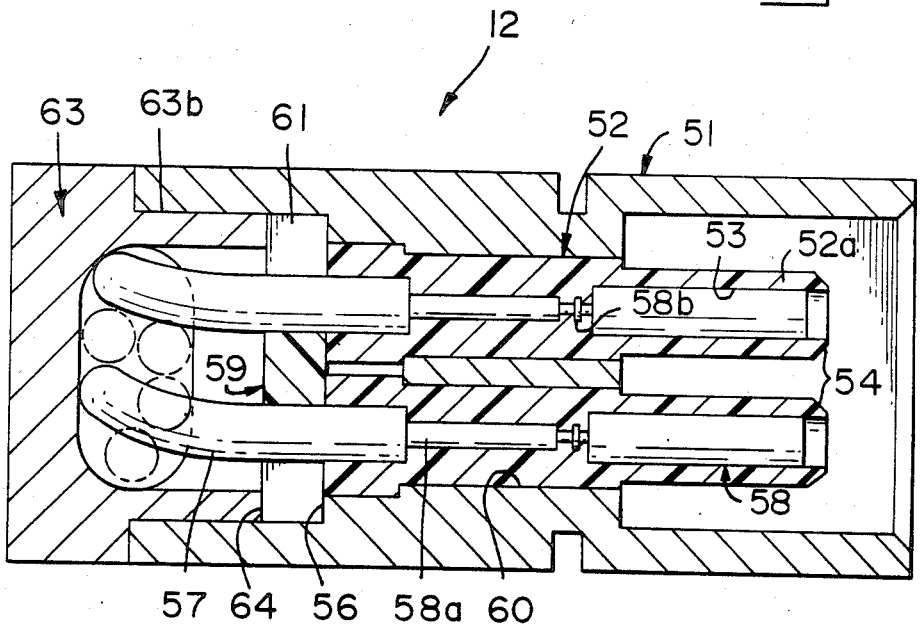
FIG. 7 is a cross-sectional view of the assembled receptacle portion of the connector of FIG. 1.

Receptacle portion 12 of connector 10 is illustrated in greater detail in FIGS. 3, 5 and 7, and comprises a rigid outer housing or shell 51 having a plurality of separate, cylindrical-shaped subassembly members 52 extending longitudinally and supported within housing 51. Each cylindrical subassembly member 52 further has a socket terminal 58 terminated to an end of electrical conductor wire 57, said terminal 58 and end of wire 57 being sealingly positioned within cylindrical member 52. Conductor wire 57 extends rearwardly from rear face 56 of cylindrical member 52. Socket terminals 58 are adapted to receive pin terminals 23 on the plug portion 11 to complete electrical circuits through the connector when plug and receptacle portions 11 and 12 are connected together.

As indicated in FIG. 3, cylindrical subassembly members 52 are supported for independent movement within receptacle portion 12 by a retaining fixture 59 which comprises a rectangular-shaped member having a plurality of slots 61 formed therein. Slots 61 preferably include chamfered portions 61*a*, as best shown in FIG. 3; and conductor wires 57 are adapted to be inserted into and to be retained within slot portions 61, as shown in FIGS. 5 and 7.

Cylindrical subassembly members 52 are formed of a plastic material having substantially the same coefficient of expansion as the material of resilient body member 17*a* of plug portion 11; and a presently preferred material for members 52 comprises silicone. Housing 51 comprises a metal housing and is preferably formed of the same material as housing 16 of plug portion 11. As best shown in FIG. 5, housing 51 is formed to define a first portion 51*a* into which the ends of cylindrical members 52 extend and which is adapted to receive plug portion 11, a second portion 51*b* comprising an integrally formed transverse wall having a plurality of passageways 60 through which the cylindrical members 52 extend, and a third portion 51*c* for receiving retaining fixture 59 and a housing cover portion 63, as will be described hereinafter. Retaining fixture 59 may conveniently be formed of a suitable thermosetting plastic such as a flame-retardant, glass-reinforced, polyester material. Conductor wires 57 preferably comprise Teflon- or silicone-insulated wires similar to conductor wires 22 in plug portion 11.

To manufacture receptacle portion 12, the ends of conductor wires 57 are first crimped, soldered, or otherwise attached to socket terminals 58. Typically these terminals have a wire barrel section 58*a* with strain relief and retention means 58*b*. Each terminal 58 with its attached wire 57 is placed into a mold cavity. The dielectric material to form cylindrical subassembly member 52 is introduced into the mold and individual cylindrical members 52 are insert molded around terminal 58 and wire 57 to seal and bind the dielectric material to the terminal and wire portion contained therein. The individual cylindrical subassembly members 52, containing terminals 58 with wire 57 attached, are then inserted into passageways 60 of second portion 51*b* (FIG. 5) in metal housing 51. The wires 57 are then positioned in the slot portions 61*a* of the retaining fixture 59, and the retaining fixture 59 is inserted through the back open end 62 of housing 51. A metal housing cover portion 63 is then pushed into the open end 62 of housing 51 and soldered or otherwise attached to the housing 51 to complete the receptacle portion 12. Alternatively wires 57 with cylindrical members attached may be inserted into retaining member 59 and the fixture containing the wires may be inserted into open end 62 of housing 51.

As shown in FIG. 3, housing cover portion 63 defines an opening 63*a* on one side thereof through which the conductor wires 57 extend into the receptacle portion 12. Although in the embodiment illustrated, housing cover portion 63 is designed for right angle entry of the conductor wires 57, housing cover portion 63 can be designed for axial wire entry if desired or required for the particular application in which the connector 10 is to be used.

Housing cover portion 63 also includes a portion 63*b* which is adapted to extend into housing 51 when the cover portion is mounted to the housing 51. Portion 63*b* is adapted to contact retaining fixture 59 and push it forward against end surfaces 56 of cylindrical members 52 until fixture 59 rests against shoulder 64 on housing 51 (FIG. 5). This causes the retaining fixture 59 to be firmly locked in position within housing 51.

FIG. 8 illustrates the plug and receptacle portions 11 and 12 of connector 10 connected together. Plug 11 is inserted into socket-receiving porion 51*a* of receptacle portion 12 as shown. This causes cylindrical members 52 to enter into aligned cylindrical cavities 18 in plug portion 11, which, in turn, causes pin terminals 23 to extend into socket terminals 58 to complete electrical circuits through the connector 10.

As best shown in FIGS. 4 and 6, resilient connector body 17*a* of plug portion 11 is molded to define an undulating surface on the peripheral walls of each of the cylindrical cavities 18. More particularly, the peripheral walls defining each cavity comprise an undulating surface having three, spaced, rounded, sealing portions 31 that function as O-rings which extend around the peripheral walls of cavities 18 and are integral with resilient connector body 17*a*. In addition, connector body 17*a* is molded to define annular raised portions 32 which are also integral with connector body 17*a* and extend upwardly from the base surface 33 of each cavity 18 and surround a portion of each of the terminals 23.

Sealing portions 31 function as radial seals when the cylindrical subassembly members 52 are inserted into cylindrical cavities 18 to seal between the peripheral walls of the cavities and the outer peripheral surfaces 52*a* of the cylindrical members 52. Annular raised portions 32 function as axial compression seals to seal between the base surfaces 33 of the cavities and the extended end surfaces 54 of the cylindrical members 52. This is illustrated most clearly in FIG. 8.

Cylindrical members 52 have a diameter which is slightly greater than the diameter of the cavities through sealing portions 31. Accordingly, when the relatively stiff, cylindrical members 52 are inserted into cavities 18, resilient sealing portions 31 will deform and spread out and form a plurality of spaced, annular seals of insulating material between the peripheral walls of the cavities and outer peripheral surfaces 52*a* of cylindrical members 52. These seals function as non-conductive barriers between adjacent terminals and as mechanical seals to prevent voltage breakdown and also to prevent dirt, moisture and other contamination from entering into the spaces between the cylindrical members 52 and the walls of their associated cavities. The sealing portions 31 thus help prevent arcing or other current flow between adjacent terminals. The diameter of sealing portions 31 can be progressively smaller from the rearward one to the forward one to reduce the mating forces between sealing portions 31 and cylindrical members 52, but still provide effective sealing therebetween.

In addition, the extended end surfaces 54 of the cylindrical members 52 will press against and deform the flexible, annular, raised portions 32 on the base surfaces 33 of cavities, causing raised portions 32 to also spread out to provide an effective seal between surfaces 33 and 52 to further prevent voltage breakdown at reduced pressure and the entry of dust, moisture or other debris.

Resilient connector body 17*a* is formed to also include an integral, annular flange 36 extending outwardly from adjacent front face 19 thereof as best seen in FIGS. 2, 4 and 8. Flange 36 is adapted to extend between metal housings 16 and 51 of plug and receptacle portions 11 and 12, respectively, to effectively seal between housing members 16, 51 when the connector 10 is assembled and to prevent entry of contaminants into the connector.

The metal housing will further completely surround the connector and provide effective shielding and strength to the connector.

When plug and receptacle portions 11 and 12 are connected each cylindrical member 52 will extend into its associated cavity 18 to cause, in turn, terminals 23 and 58 to mate to complete electrical circuits through the connector. Because cylindrical members 52 are independently movable within receptacle portion 12, each member 52 will automatically align itself within its associated cavity 18 when the connector portions 11, 12 are connected. This self-aligning capability provides increased assurance that a complete and effective mechanical seal will be established and maintained between each cylindrical member 52 and the walls of its associated cavity, resulting in a more reliable connector. This self-aligning capability permits cylindrical members 52 to correct for any slight misalignment that might exist between one or more of the cylindrical members and its associated cavity. Thus, the connector can be made to somewhat less exacting tolerances than prior connectors, resulting in reduced manufacturing costs.

In addition, because the cylindrical members 52 are movable within their respective cavities, there will be less friction between the cylindrical members 52 and the walls of the cavities when connector portions 11, 12 are connected together or pulled apart. This results in reduced wear of the resilient walls of the cavities 18 and an increased useful life expectancy for the connector system.

With the present invention, each cylindrical 52 member essentially floats within its associated cavity 18 substantially fully surrounded by the resilient radial and axial compression seals 31 and 32. Each mated terminal pair, therefore, can be more effectively and reliably electrically isolated from adjacent mated terminals. This isolation can be effectively maintained despite any slight relative movement of the connector portions as a result of thermal expansion that may be encountered during use of the connector.

The shielded connector 10 of the present invention can be assembled in a package of about one-half inch by one inch, essentially the same size as the unshielded connector disclosed in U.S. Pat. No. 3,842,393, and is fully interchangeable with the unshielded connector. The sealing structure provided is effective in isolating the terminals from one another to prevent voltage breakdown, arcing or other losses therebetween and does not require the use of potting materials as in many prior connectors. The connector 10 is particularly designed for use in high-voltage applications and can reliably carry 6 KVDC throughout a temperature range of from about −55° C. to about +125° C. and over a broad range of pressure.

While what has been described constitutes a presently preferred embodiment, it should be understood that the connector can be varied in numerous ways without departing from the invention. For example, although a six-pin connector is described and illustrated, connectors having different numbers of pins and different pin placements could also be provided if desired. Accordingly, it should be understood that the invention is to be limited only insofar as is required by the scope of the following claims.

We claim

1. A microminiature, high-voltage, multi-pin connector comprising:

first and second housing means, said second housing means being integrally formed with a transverse wall having a plurality of passageways extending therethrough, each of said passageways having an essentially constant diameter;

a first connector portion disposed in said first housing means, said first connector portion including a relatively resilient connector body having a plurality of cylindrical cavities therein, each of said cylindrical cavities including a peripheral surface and a base surface and having a pin terminal extending substantially axially into said cavity from said base surface, said pin terminal being terminated on a first insulated electrical conductor;

a second connector portion disposed in said second housing means and adapted to be connected to said first connector portion, said second connector portion, including a plurality of separate, relatively rigid, cylindrical members disposed in said passageways and positioned to extend into said plurality of cavities when said first and second connector portions are connected, each of said plurality of cylindrical members containing a socket terminal terminated to a second insulated electrical conductor, said socket terminals being matable with said pin terminals in said cavities when said cylindrical members extend into said cavities, the cylindrical members including an outer peripheral surface and an extended end surface, said second connector portion further including a separate retaining member for retaining one end of said plurality of separate cylindrical members and a portion of said second insulated electrical conductors while permitting said cylindrical members to move independently relative to one another;

means provided by a cover member and said second housing means to secure said retaining member in said second housing means;

a plurality of sealing portions integral with said resilient connector body and extending around the peripheral surface of each cavity at spaced locations thereon, said plurality of sealing portions comprising radial seals to be compressed by said cylindrical members upon insertion of said cylindrical members into said cavities to act as barriers in the air gaps between the outer peripheral surfaces of said cylindrical members and the peripheral surfaces of said cavities, said sealing portions functioning as O-rings; and an axial compression seal integral with said resilient connector body and extending upwardly from the base surface of each cavity, each axial compression seal comprising an annular raised portion of said resilient connector body surrounding a portion of said pin terminal to be compressed by said cylindrical members upon insertion of said cylindrical members into said cavities to act as a barrier in the air gaps between the extended end surfaces of said cylindrical members and the base surfaces of said cavities.

2. The microminiature, high-voltage, multi-pin connector as described in claim 1 wherein said first connector portion is formed by insert molding around a portion of said first insulated conductors and the pin terminals terminated thereto, and said second connector portion is formed by insert molding around a portion of said second insulated conductors and the socket terminals terminated thereto.

3. The microminiature, high-voltage, multi-pin connector as described in claim 1 wherein said first and second housing means are metal, thereby providing shielding for said connector.

4. A microminiature, high-voltage, multi-pin connector comprising:

first and second housing means, said second housing means being interally formed with a transverse wall having a plurality of passageways extending therethrough, each of said passageways having an essentially constant diameter;

a first connector portion disposed in said first housing means, said first connector portion including a relatively resilient connector body having a plurality of cylindrical cavities therein, each of said cylindrical cavities including a peripheral surface and a base surface and having a pin terminal extending substantially axially into said cavity from said base surface, said pin terminal being terminated on a first insulated electrical conductor;

a second connector portion disposed in said second housing means and adapted to be connected to said first connector portion, said second connector portion including a plurality of separate, relatively rigid, cylindrical members disposed in said passageways and positioned to extend into said plurality of cavities when said first and second connector portions are connected, each of said plurality of cylindrical members containing a socket terminal terminated to a second insulated electrical conductor, said socket terminals being matable with said pin terminals in said cavities when said cylindrical members extend into said cavities, the cylindrical members including an outer peripheral surface and an extended end surface, said second connector portion further including a separate retaining member for retaining one end of said plurality of separate cylindrical members and a portion of said second insulated electrical conductors while permitting said cylindrical members to move independently relative to one another;

means provided by a cover member and said second housing means to secure said retaining member in said second housing means; and a plurality of sealing portions integral with said resilient connector body and extending around the peripheral surface of each cavity at spaced locations thereon, said plurality of sealing portions comprising radial seals to be compressed by said cylindrical members upon insertion of said cylindrical members into said cavities to act as barriers in the air gaps between the outer peripheral surfaces of said cylindrical members and the peripheral surfaces of said cavities, said sealing portions functioning as O-rings.

5. The microminiature, high-voltage, multi-pin connector as described in claim 4 wherein said first connector portion is formed by insert molding around a portion of said first insulated conductors and the pin terminals terminated thereto, and said second connector portion is formed by insert molding around a portion of said second insulated conductors and the socket terminals terminated thereto.

6. The microminiature, high-voltage, multi-pin connector as described in claim 4 wherein said first and second housing means are metal, thereby providing shielding for the connector.

* * * * *